US006938698B2

(12) United States Patent
Coronado

(10) Patent No.: US 6,938,698 B2
(45) Date of Patent: Sep. 6, 2005

(54) SHEAR ACTIVATED INFLATION FLUID SYSTEM FOR INFLATABLE PACKERS

(75) Inventor: Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 151 days.

(21) Appl. No.: 10/647,498

(22) Filed: Aug. 25, 2003

(65) Prior Publication Data

US 2004/0256114 A1 Dec. 23, 2004

Related U.S. Application Data

(60) Provisional application No. 60/427,290, filed on Nov. 18, 2002.

(51) Int. Cl.[7] ..... E21B 33/127
(52) U.S. Cl. ..... 166/387; 166/106; 166/122
(58) Field of Search ..... 166/387, 106, 166/122, 126, 127

(56) References Cited

U.S. PATENT DOCUMENTS

| | | | | |
|---|---|---|---|---|
| 3,783,940 A | | 1/1974 | Urbanoski | 166/181 |
| 4,083,406 A | | 4/1978 | Metz | 166/286 |
| 4,663,366 A | | 5/1987 | Drake et al. | 523/130 |
| 4,913,232 A | | 4/1990 | Cheymol et al. | 166/285 |
| 5,190,109 A | | 3/1993 | Pardo | 166/387 |
| 5,316,081 A | * | 5/1994 | Baski et al. | 166/188 |
| 5,488,994 A | | 2/1996 | Laurel et al. | 166/387 |
| 6,073,694 A | | 6/2000 | Crawshaw | 166/292 |
| 6,273,195 B1 | * | 8/2001 | Hauck et al. | 166/374 |
| 6,341,654 B1 | * | 1/2002 | Wilson et al. | 166/387 |

FOREIGN PATENT DOCUMENTS

| | | | |
|---|---|---|---|
| EP | 0 819 830 A2 | 1/1998 | E21B/33/127 |
| GB | 2 320 734 A | 7/1998 | E21B/33/127 |
| WO | WO 94/28085 | 8/1994 | |

* cited by examiner

*Primary Examiner*—Frank Tsay
(74) *Attorney, Agent, or Firm*—Madan, Mossman & Sriram, P.C.

(57) ABSTRACT

A subterranean well packer is inflated by a pumped transfer of rheotropic fluid through a tortuous flow channel into a packer sealing element expansion chamber. The tortuous flow channel and fluid delivery pressure are coordinated with the fluid properties to impose sufficient fluid shear stress for inducement of a substantial phase change in said rheotropic fluid after entry into expansion chamber.

15 Claims, 1 Drawing Sheet

SHEAR ACTIVATED INFLATION FLUID SYSTEM FOR INFLATABLE PACKERS

CROSS-REFERENCE TO RELATED APPLICATIONS

This application claims the priority U.S. Provisional Patent Application Ser. No. 60/427,290, filed Nov. 18, 2002.

BACKGROUND OF THE INVENTION

1. Field of the Invention

The present invention relates to methods and apparatus for completing and maintaining subterranean wells for producing oil, gas and other fluids and minerals from the earth. In particular, the invention relates to a method and apparatus for setting a well annulus packer or bridge plug.

2. Description of Related Art

Packers and bridge plugs are devices for sealing the annulus of a borehole between a pipe string that is suspended within the borehole and the borehole wall (or casing wall). Hereafter, the term "packer" will be used as a generic reference to packers, bridge plugs or other such flow channel obstructions. The functional purpose of a packer is to obstruct the transfer of fluid and fluid pressure along the length of a flow channel such as a borehole.

Typically, inflatable packer assemblies utilize either mud, water or cement to inflate an elastomer (rubber) bladder from a tubular mandrel. The mandrel is a pipe joint in an assembly string of tubing suspended within a well bore. Inflation of the bladder seals it against a well bore or casing wall to obstruct the annulus continuity between the well wall and tubing string. Inflatable packers expanded by mud or water typically utilize a valve system to maintain fluid pressure in the packer bladder. Cement systems, on the other hand, generally rely on the compressive strength of the cured or hardened cement. Both systems have inherent deficiencies.

A packer that is inflated with mud or water is dependent solely on the reliability of the valve that confines the fluid pressure charge. Leakage of the valve results in deflation of the packer and loss of the annulus seal. Characteristically, cement is compounded as a pumpable non-heterogeneous liquid. Over a relatively short working time, free water in the compound is captured (cured) to alter the compound phase from liquid to solid. Accordingly, liquid phase cement is needed to inflate this packer bladder. After a curing time of a few hours, sufficient compressive strength to support significant weight above the packer. Considering the fact that the packer setting event occurs under the control and direction of a rig crew and that rig expenses are in the tens of thousands of dollars per hour, the time devoted to cement curing is enormously expensive.

For a truly long-term or permanent packer, traditional wisdom will hold for the inflating fluid to be solid within the bladder to prevent leakage over time and to resist thermal effects which are generally more dramatic in fluids than in most solids. Consequently, the bladder of permanent packers is most often inflated by cement. The time lapse after mixing phase change from liquid to solid for cement may be controlled to some degree, by formulation. However, temperature and well fluid contamination may sometimes uncontrollably influence the phase change interval.

Moreover, a significant caveat to the use of a cement inflated packer is the consequence of an error in positioning the packer. If erroneously set within a well fluid production zone, there is great potential for irreparable well damage.

Accidental spillage within the wellbore is also a major concern. Use of cement inflated packers, therefore, carries a high risk element.

U.S. Pat. No. 5,488,994 describes a fluid phase change system for setting a packer wherein the packer bladder is inflated by a polymer resin. As the resin is pumped into the bladder expansion voids, the resin flow is channeled over and mixed with a catalyst material. An in situ phase change of the resin occurs within the bladder voids as a consequence of the catalyst chemical reaction. Similar to cement set packers, the resin that inflates the packer bladder as a liquid, reacts into a solid to permanently secure the inflated profile.

An object of the present invention, therefore is provision of a phase changing inflation system for well packers that is neither time nor temperature dependent for changing from a liquid phase to inflate the packer to a solid phase to secure the packer.

Another object of the invention is an inflation system for well packers in which a liquid that is pumped down a tubing or pipe string flow bore is not stimulated to a phase change until actually entering a packer inflation chamber.

A further object of the invention is an inflation system for well packers in which only liquid that actually enters a packer inflation chamber is stimulated to a phase change.

Also an object of the invention is reduction, if not elimination, of uncertainties associated with actual bottom hole temperatures the heat generated within a packer inflation fluid as it is being pumped into a well and the time required to complete the operations.

SUMMARY OF THE INVENTION

The present invention offers a system for setting a permanent well packer by inflation that is alternative to the time and temperature dependent prior art described above. Pursuant to the present invention, the packer inflation fluid may be a rheotropic liquid that is formulated to phase change from the liquid to solid state only after receiving a predetermined degree of fluid flow shear stress. Fluids of this character are described expansively by U.S. Pat. No. 4,663,366 and PCT Application WO 94/28085. Teachings respective to both of these references are incorporated herein by this reference.

An activating shear stress parameter for a rheotropic liquid may be a predetermined number and quantity of fluid flow velocity changes as the inflation fluid enters the packer inflation chamber. Such measured flow velocity changes for the inflation fluid are induced by a tortuous flow path into the packer inflation chamber. The required degree of shear stress is substantially greater than the stress induced by the normal pumping required to deliver the inflation fluid to the packer location.

The tortuous fluid flow path may be a labyrinthine channel within the packer valve collar formed by an alternating series of spaced baffles or discs that are perforated by misaligned apertures. Pump pressure behind the inflation fluid forces the fluid to negotiate the many flow path reversals as it courses into the packer expansion chamber.

Only fluid that completes the labyrinth traversal into the expansion chamber may solidify or otherwise create a sufficiently high gel strength to be practical. Consequently, much of the risk associated with using a phase change inflation fluid is removed due to the circumstance that until actually entering the packer expansion chamber, the fluid will continue in the liquid state. The factors of time and temperature are also eliminated or significantly reduced from consideration.

BRIEF DESCRIPTION OF DRAWING

For a through understanding of the present invention, reference is made to the following detailed description of the preferred embodiments, taken in conjunction with the accompanying drawing in which.

DESCRIPTION OF PREFERRED EMBODIMENTS

Figure 1:
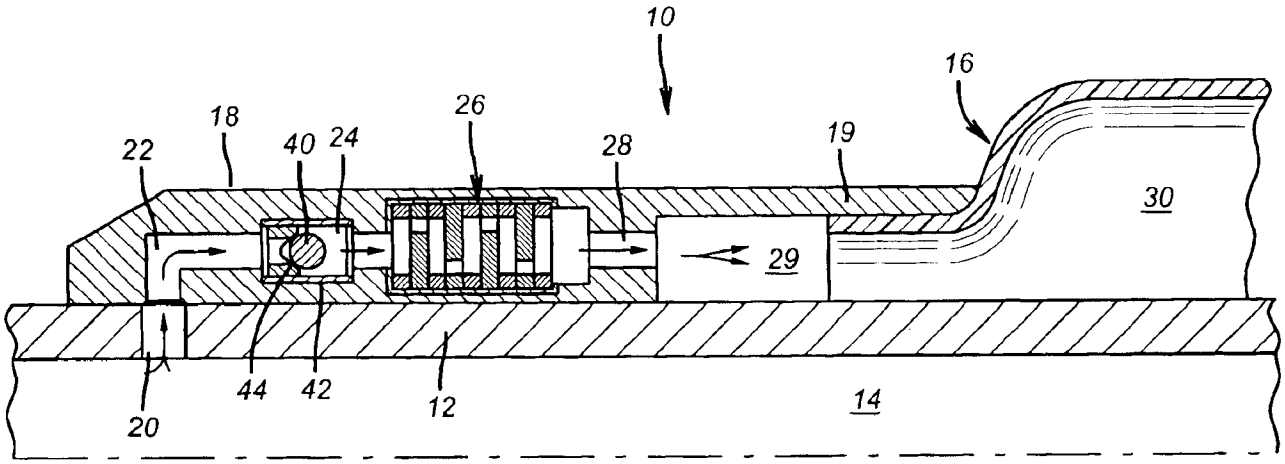
FIG. 1 schematically represents a partial cross-section of the invention taken along a cutting plane parallel with the axis of a packer flow bore; and, FIG. 2 is an enlarged schematic cross-section of the inflating fluid flow labyrinth.

Giving initial reference to FIG. 1, the present invention packer 10 comprises a tubular mandrel 12 that encompasses a fluid flow bore 14. The mandrel 12 is an integral element of a well work string. The flow bore 14 is a fluid flow conduit usually having continuity with the well surface and may carry a pumped delivery of well working fluid.

The packer bladder 16 may be, for example, a reinforced rubber or polymer tube that extends substantially the full length of the mandrel. At each tubular end, the bladder is secured to the mandrel 12 by collars having a lipped overlay 19. Between the collars, an uninflated bladder tightly overlies the mandrel 12 for running into and placement within the well. When expanded by fluid pressure, the overlaid bladder tube 16 expands from the mandrel surface to form an inflation chamber 30. One of the collars, the valve collar 18, is tooled for an inflation conduit 22. A fluid flow aperture 20 through the mandrel 12 wall is aligned with the collar inflation conduit 22.

Between the flow aperture 20 and the packer inflation chamber 30, the inflation conduit 22 includes several fluid flow control elements comprising a fluid flow check valve, 24 and a flow labyrinth 26. In some cases, fluid flow through the inflation conduit 22 may also be restricted by pressure responsive opening and closing valves (not illustrated) whereby the inflation conduit 22 is opened at a predetermined threshold pressure and is closed by a second pressure that is greater than the threshold pressure.

The check valve 24 maybe of traditional design having, for example, a ball element 40 caged within a flow-through housing 42. A closure seat 44 on the in-flow end of the housing 42 cooperates with the ball element 40 to rectify fluid flow through the check valve. Flow directed through the seat 44 displaces the ball from the seat to permit flow passage. Attempted flow directed in the opposite direction against the ball element imposes a pressure differential force on the ball element that presses the ball element 40 into a fluid seal engagement with the closure seat 44. Thus, the fluid flow is rectified in a single direction.

The flow labyrinth 26 may take many forms to induce a predetermined magnitude of hydrodynamic shear into the flow stream of fluid driven through the labyrinth 26 in the collar manifold 29 and expansion chamber 30. The fluid, a rheotropic liquid such as disclosed by U.S. Pat. No. 4,663,366 and PCT Application WO 94/28085, has the property of changing phase from liquid to solid or semi-solid by undergoing a predetermined quantity of fluid shear such as imposed by sharp flow reversals.

Figure 2:
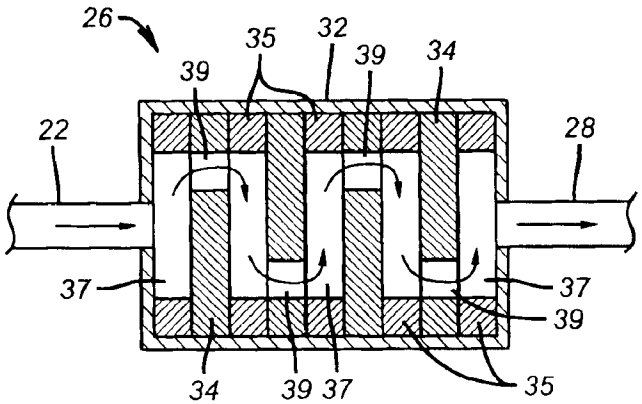

The presently preferred example of the labyrinth 26 is illustrated in detail in FIG. 2 to include a series of discs or baffles 34 aligned in a chamber volume 32 between the conduit 22 and an expansion chamber port 28. The baffles 34 are separated by spacer rings 35 to provide fluid flow spaces 37 between the baffles 34. The baffles 34 are perforated by apertures 39 to communicate the flow space 37 on opposite faces of a baffle 34. However, the several apertures 39 are arranged in successive off-set alignment to cause a tortuous flow path through the chamber volume. Upon emerging from each aperture 39, the fluid flow stream is forced to an abrupt flow directional change into the space 37. Within the space 37, the flow stream runs transversely to the aperture 39 flow direction into the next successive aperture 39. Through each successive stage of flow reversal within the labyrinth 26, the fluid is dynamically sheared to stimulate a rheotropic phase change. The number of baffles used can be varied depending on the shear requirements of the rheotropic fluid.

In a traditional operation, the tubing string that includes this packer 10 is provided with a flow bore obstruction mechanism to allow the flow bore to be pressurized by a mud supply pump. When the packer is suitably positioned within the well bore, the rheotropic fluid is pumped into the tubing flow bore behind a bore closing device such as a valve ball. When the bore closure ball engages a ball seat below the packer, the flow bore filled with rheotropic fluid may be pressurized to open the collar conduit 22. When opened, the fluid transverses the labyrinth 26 into the packer expansion chamber 30.

Upon emerging from the labyrinth 26, the stimulated fluid passes through the chamber port 28 into the collar manifold 29 for the distribution about the packer annulus into the expansion chamber 30. A continued delivery of the stimulated fluid into the expansion chamber 30 enlarges the bladder 16 to compressive engagement with the well bore or casing wall. However, upon achieving quiescence, the fluid within the chamber 30 congeals to a solid or semi-solid phase.

It is only the fluid that has passed through the labyrinth 26 that has been sufficiently stimulated to congeal. The rheotropic fluid remaining in the tubing flow bore 14 continues in the liquid state. As a liquid, the rheotropic fluid in the flow bore 14 may be further pressurized to open one or more circulation or production sleeves. Through such circulation or production sleeves, the rheotropic fluid in the flow bore may be displaced by other well working fluids or by formation fluid production.

Although the invention has been described in terms of particular embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A subterranean well packer comprising:

(a) a tubular mandrel formed about a fluid flow bore;

(b) a resilient well sealing element formed about said mandrel and secured thereto at opposite axial ends whereby said element may be expanded to form a fluid seal with a well wall;

(c) an expansion chamber between said sealing element and said mandrel;

(d) a fluid flow channel between said fluid flow bore and said expansion chamber; and, (e) a fluid flow labyrinth in said fluid flow channel for activating a rheotropic fluid.

2. A well packer as described by claim 1 wherein said fluid flow channel comprises a one-way fluid flow check valve.

3. A well packer as described by claim 2 wherein said labyrinth is positioned in said flow channel between said check valve and said expansion chamber.

4. A well packer as described by claim 1 wherein the fluid flow labyrinth comprises a chamber having a series of baffles disposed therewithin in a substantially parallel relation to define a plurality of fluid flow spaces within the chamber.

5. A well packer as described by claim 4 wherein each of the baffles contains a fluid flow aperture, each of the fluid flow apertures being misaligned with fluid flow apertures in neighboring baffles so as to create a tortuous flow path through the chamber.

6. A well packer as described by claim 2 wherein said check valve comprises a ball-shaped valve member that is biased against a valve closure seat.

7. A well packer comprising:

(a) a tubular mandrel formed about a fluid flow bore;

(b) a resilient well sealing element formed about said mandrel and secured thereto at opposite axial ends whereby said element may be expanded to form a fluid seal with a well wall;

(c) an expansion chamber between said sealing element and said mandrel; and, (d) a labyrinthine fluid flow path for ingress of fluid into the expansion chamber, the fluid flow path being sufficiently labyrinthine to activate a rheotropic fluid.

8. A well packer as described by claim 7 further comprising a one-way fluid flow check valve.

9. A well packer as described by claim 7 wherein the fluid flow labyrinth comprises a chamber having a series of baffles disposed therewithin in a substantially parallel relation to define a plurality of fluid flow spaces within the chamber.

10. A well packer as described by claim 9 wherein each of the baffles contains a fluid flow aperture, each of the fluid flow apertures being misaligned with fluid flow apertures in neighboring baffles so as to create a tortuous flow path through the chamber.

11. A well packer as described by claim 8 wherein said check valve comprises a ball-shaped valve member that is biased against a valve closure seat.

12. A method of setting a subterranean well packer comprising the steps of:

providing a tortuous flow path for a packer inflation fluid proximate of a packer element inflation chamber; and, inflating said packer element with a rheotropic fluid delivered along said tortuous flow path into said inflation chamber.

13. A method as described by claim 12 wherein flow of said rheotropic fluid along said flow path is restricted to one-way flow.

14. A method as described by claim 12 wherein the tortuous flow path is provided by a series of baffles disposed therewithin in a substantially parallel relation to define a plurality of fluid flow spaces therebetween within the chamber.

15. The method of claim 13 wherein the flow of said rheotropic fluid is restricted to one way flow by a check valve.

* * * * *